US006212704B1

(12) United States Patent
Peterson

(10) Patent No.: US 6,212,704 B1
(45) Date of Patent: Apr. 10, 2001

(54) BATHTUB WALK THROUGH INSERT

(76) Inventor: Craig S. Peterson, 2425 S. Progress Dr., Salt Lake City, UT (US) 84119

( * ) Notice: Subject to any disclaimer, the term of this patent is extended or adjusted under 35 U.S.C. 154(b) by 0 days.

(21) Appl. No.: 09/556,373

(22) Filed: Apr. 24, 2000

(51) Int. Cl.[7] ..... A47K 3/02

(52) U.S. Cl. ..... 4/555; 4/584

(58) Field of Search ..... 4/538, 555, 584

(56) References Cited

U.S. PATENT DOCUMENTS 5,628,851 * 5/1997 Lawler ..... 4/555 X

* cited by examiner

*Primary Examiner*—Robert M. Fetsuga

(57) ABSTRACT

A molded acrylic bathtub walk through insert to be positioned in a cut out formed in a bathtub wall and having a skirt member to surround a step through portion with raised opposite ends providing walls to engage and bond to edges of the cut out portion in the bathtub wall and with the skirt sealingly engaging the bathtub floor, the inner and outer surfaces of the bathtub wall in which the insert is positioned and the structural floor outside of the bathtub, and a method of installing the insert in a bathtub wall.

4 Claims, 2 Drawing Sheets

BATHTUB WALK THROUGH INSERT

CROSS REFERENCE TO RELATED APPLICATIONS

Not Applicable

STATEMENT REGARDING FEDERALIY SPONSORED RESEARCH OR DEVELOPMENT

Not Applicable

REFERENCE TO A MICROFICHE APPENDIX

Not Applicable

BACKGROUND OF THE INVENTION

Figure 1:
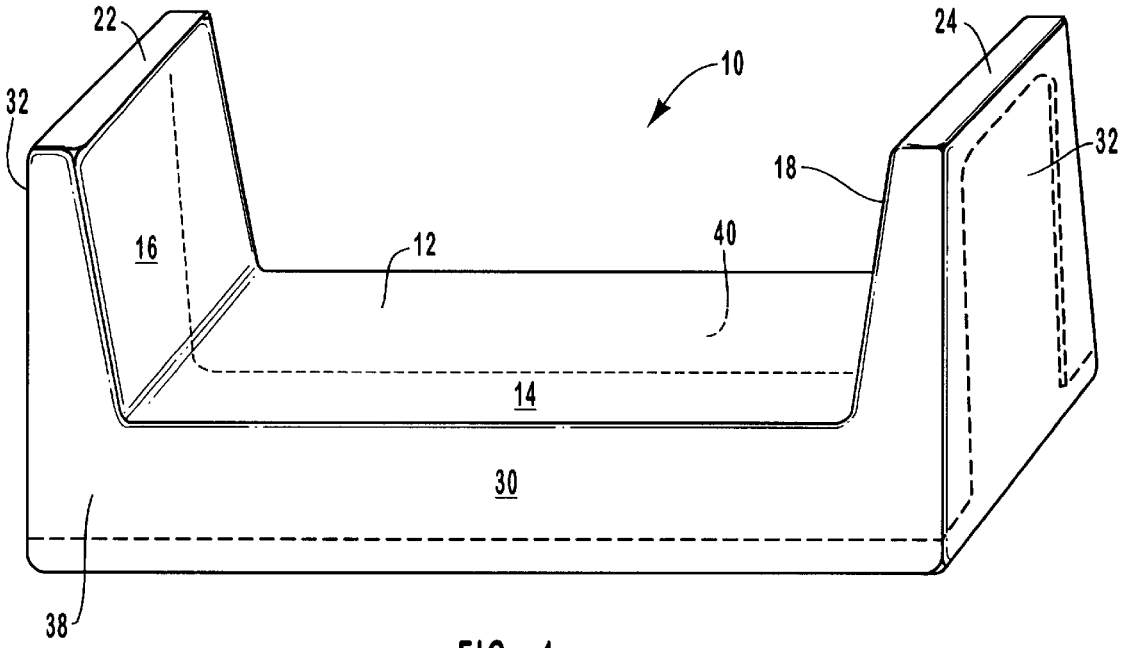

This invention relates to walkthrough inserts for bathtubs and is particularly related to inserts placed in sidewalls of cut-away portions of existing bathtubs.

BRIEF SUMMARY OF THE INVENTION

It is well recognized that many people, because of advancing age or infirmities reach a stage in life where they cannot step over the usual sidewall of a bathtub, to accomplish bathing or showering in the tub. It is, of course, possible to remove the bathtub and to install a shower-system that does not require a user to step over the usual bathtub sidewall. However, a less costly solution to the problem of providing access to a shower is often found in cutting out a portion of the bathtub sidewall and providing a replacement insert that provides a much lower sidewall portion that the user can easily step through to enter the bathtub. With this arrangement the tub does not need to be removed, so the tub and the already available shower unit discharging into the tub can be used and the entire area where the tub is located does not need to be remodeled and refinished.

One form of insert used to finish the wall of a bathtub after a portion of the usual bathtub wall has been cut out is shown in U.S. Pat. No. 6,061,846, issued May 16, 2000. The insert disclosed in this patent is made of plastic materials that can be rotationally or blow molded and is suitable for a great many uses. However, plastic materials suitable for rotational or blow molding have a very fine surface porosity, and with time, dirt will collect in the pores of inserts made using these processes. Even when thoroughly cleaned the insert will take on a spotted, stained appearance. This may not be a problem if the insert is made of suitable colors or combinations of colors, but may be objectionable if the insert is made in white or some other light colors.

Principal objects of the present invention are to provide an improved walkthrough insert for bathtubs, having a non-porous exterior surface and shaped to be easily installed to a bathtub having a portion of the bathtub sidewall removed.

Other objects are to provide an improved walkthrough insert for bathtubs that is economically produced and that can be installed by persons having only limited training in the installation process used.

Still another object is to provide an insert that can be secured in place while maintaining the strength and integrity of the bathtub in which the insert is installed.

Principal features of the invention include an acrylic insert with a non-porous outer surface, a step through portion with raised opposite walls and a skirt extending downwardly from the step through portion and from an upper terminus of ends of each of the raised opposite walls. During installation of the insert the skirt is cut away, as necessary to insure simultaneous contact of a bottom edge of the skirt with the bathtub bottom and the floor surface outside the bathtub. The portion of the skirt connected to the raised opposite walls is further trimmed to insure bonding contact of the raised opposite walls with cut surfaces of a cut out portion of the bathtub wall and with reinforcement members positioned within the walls of the bathtub surrounding the cut out portion of the bathtub wall. The remaining portion of the skirt engages and is bonded to the inner and outer surfaces of the bathtub wall in which the insert is positioned.

Additional objects and features of the invention will become apparent to those skilled in the art to which the invention pertains from the following detailed description and drawings, disclosing what is presently contemplated as being the best mode of the invention.

DRAWINGS

Figure 2:
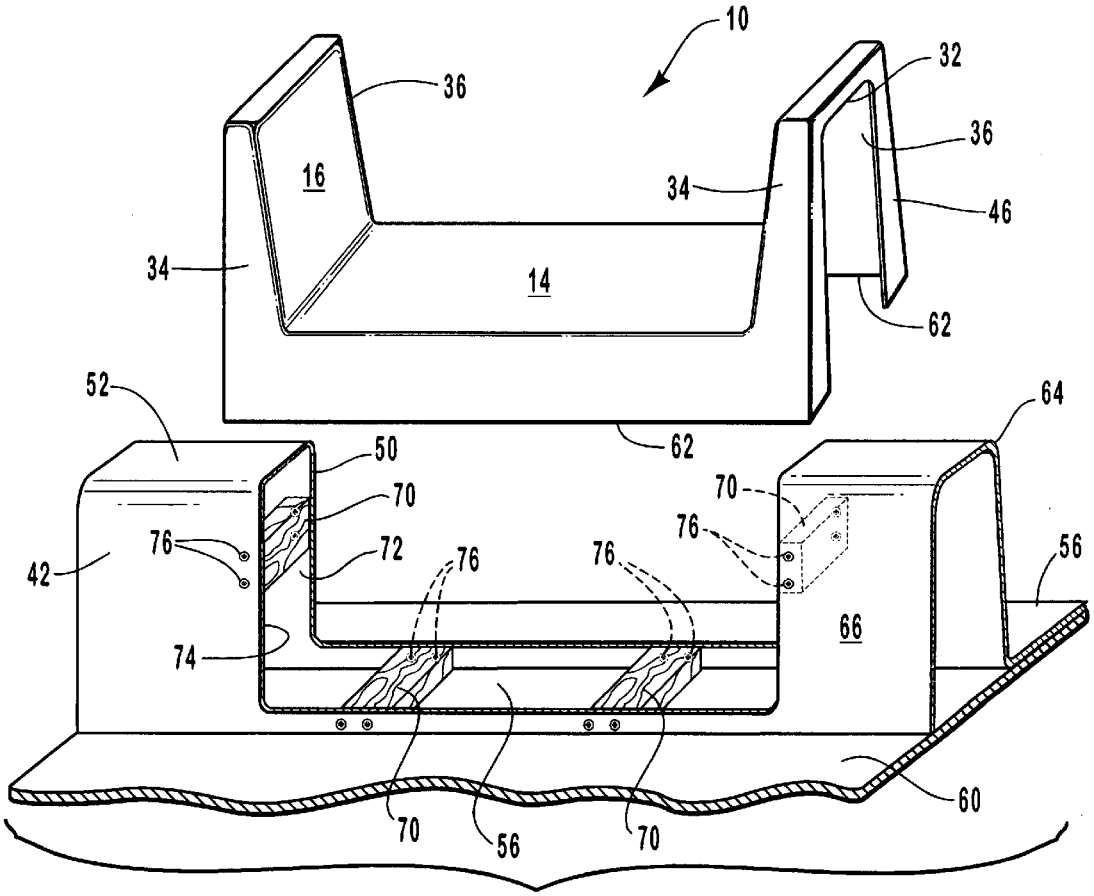
Figure 3:
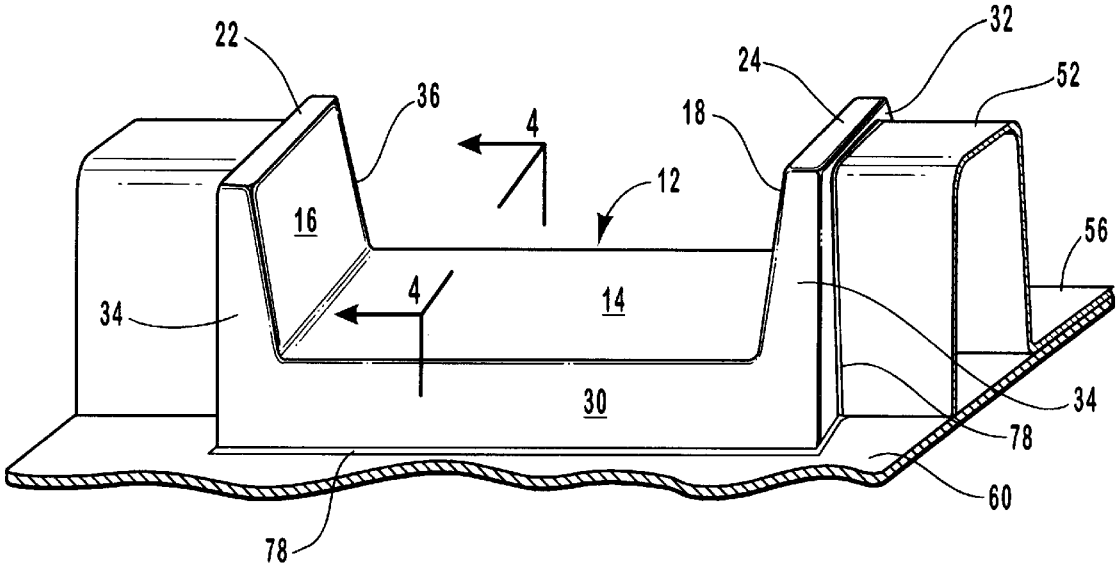
Figure 4:
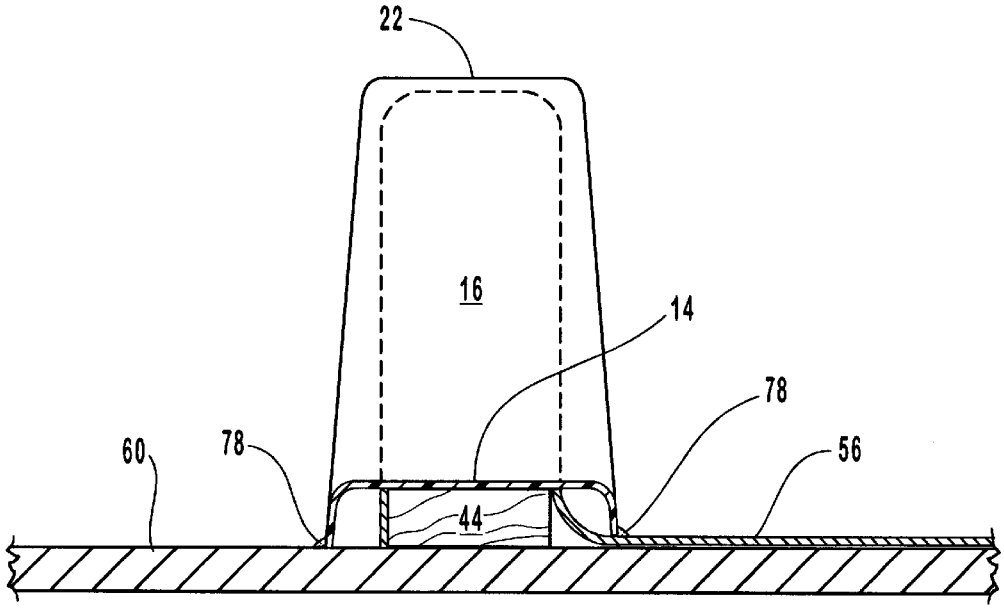

In the drawings:

FIG. 1 is a perspective view of the walk through bathtub wall insert of the invention;

FIG. 2, an exploded view of the bathtub wall insert of FIG. 1 being inserted into the opening formed by cutting out a portion of a bathtub sidewall;

FIG. 3, a perspective view of the bathtub wall insert positioned in a cut out portion of the bathtub and secured to the bathtub wall; and FIG. 4, a vertical section, taken on the line 4—4 of FIG. 3.

DETAILED DESCRIPTION

Referring now to the drawings:

In the illustrated preferred embodiment, the bathtub wall insert of the invention is shown generally at 10. As shown, the insert 10 includes a step through portion 12 with a substantially flat, elongate upper surface 14. Raised walls 16 and 18 project upwardly from opposite ends of the step through portion 12, terminating at top surface 22 and 24, respectively.

A skirt 30 has a portion 32 extending from each of the top surfaces 22 and 24, away from the step through portion 12, and down to engage side portions 34 and 36 respectively provided at opposite sides 38 and 40 of the step through portion 12 and the raised walls 16 and 18. Skirt 30 thus extends fully around and projects from the step through portion 12 and the raised walls 16 and 18.

The step through portion 12, raised walls 16 and 18 and skirt 30 are formed as a single piece of molded acrylic material and the skirt 30 is slightly flared outward from the step through portion 12 and the raised walls 16 and 18, as necessary to allow the molded assembly to be removed from the mold used in production of the assembly.

The step through portion 12 and each of the raised walls 16 and 18 has a width greater than a bathtub wall 42 of the bathtub in which the insert 10 is to be installed. To accomplish installation the opposite ends 44 and 46 of the skirt are cut out to allow the skirt to fit snugly over the wall of the bathtub at opposite ends of the opening 50 formed by cutting out a portion of the bathtub wall 42.

The removed portion of the wall 42 is created by making vertical spaced apart cuts from the top 52 of the bathtub wall 42 to the floor 56 of the bathtub at the inside of the bathtub and to the structural floor 60 at the outside of the bathtub wall. The spaced apart cuts are connected by cutting along the bathtub floor 56 and along the structural floor 60. The cut out portion of the bathtub wall is then removed and discarded.

The bottom edge 62 of skirt 30 is trimmed so that when the skirt fits snugly over the sidewall of the bathtub the skirt also engages the floor 56 of the bathtub, the structural floor 60 and the inside surface 64 and the outside surface 66 of the bathtub wall 42.

Reinforcement members 70, which may be made of wood may be inserted between the inner wall 72 and the outer wall 74 of the bathtub to provide additional strength to the bathtub wall and to provide additional bonding surfaces for bonding the raised walls 16 and 18 to the bathtub wall 42. Screws 76, inserted through the bathtub wall 42 and floor 56 into the reinforcement members hold the reinforcement members in place. The screws are hidden by skirt 30 after the insert 10 is positioned. A bead 78 of suitable bonding and sealing material is placed around the engagement of skirt 30 with the inside and outside of bathtub wall 42, the bathtub floor 56 and the structural floor 60.

The insert 10 of the invention is readily formed of acrylic material that cannot be shaped using blow molding or rotational molding techniques. When installed the insert 10 maintains a clean appearance and appears as an attractive, integral part of a bathtub.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A bathtub walk through insert comprising a step through portion with a substantially flat, elongate upper surface having spaced apart ends at opposite ends of the extended length of said upper flat surface and side edges interconnecting said spaced apart ends;

a wall extending across each spaced apart end and projecting upwardly from such spaced apart end to a top surface that projects from said wall, substantially parallel to said upper surface;

a skirt extending downwardly from each side of said top surface and downwardly from said side edges of said flat, elongate upper surface and including ends of said skirt spaced from said upper surface and extending between opposite sides of said skirt; and wherein said step through portion, said wall and said skirt are all formed as a single piece of acrylic material.

2. A bathtub walk through insert as in claim 1 wherein said skirt is flared outwardly from the top surfaces and the side edges of the flat, elongate upper surface.

3. A method of installing a bathtub walk through insert having a step through portion with a substantially flat, elongate upper surface with spaced apart ends at opposite ends of the extended length of said upper flat surface and side edges interconnecting said spaced apart ends, a wall extending across each spaced apart end and projecting upwardly from said spaced apart end to a top surface that projects from said wall, substantially parallel to said upper surface, a skirt extending downwardly from each side of each said top surface and downwardly from said side edges of said flat, elongate upper surface comprising the steps of cutting away a portion of a bathtub side wall to receive the step through portion;

cutting away the skirt to permit positioning of the step through portion with the flat, elongate upper surface and each of the walls in engagement with surfaces forming the cut away portion of the bathtub wall and the skirt to engage the bathtub wall, the bottom of the bathtub and a portion of structural floor outside the bathtub; and bonding the insert to the surfaces of the tub engaged by the insert.

4. A method as in claim 3, further including securing reinforcement members within the bathtub wall and beneath the bathtub floor before positioning the step through portion and bonding the bathtub walk through insert to said reinforcement members.

* * * * *